US006287158B1

(12) United States Patent
Brammer

(10) Patent No.: US 6,287,158 B1
(45) **Date of Patent: *Sep. 11, 2001**

(54) CONTACT ELEMENT

(75) Inventor: Hartmut Brammer, Vaihingen (DE)

(73) Assignee: Robert Bosch GmbH, Stuttgart (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/310,642

(22) Filed: May 12, 1999

(30) Foreign Application Priority Data

May 14, 1998 (DE) ..... 298 08 642 U

(51) Int. Cl.[7] ..... H01R 4/02
(52) U.S. Cl. ..... 439/874; 439/884
(58) Field of Search ..... 439/884, 874, 439/877, 882, 866, 601, 422; H01R 9/24, 13/04, 4/02, 4/10, 4/18, 13/40, 4/24

(56) References Cited

U.S. PATENT DOCUMENTS

| | | | | |
|---|---|---|---|---|
| 2,204,408 | * | 6/1940 | Folsom | 439/857 |
| 2,759,163 | * | 8/1956 | Ustin et al. | 439/866 |
| 3,953,103 | * | 4/1976 | Mathis | 439/82 |
| 4,679,887 | | 7/1987 | Jackson . | |
| 4,764,133 | * | 8/1988 | Kaneko | 439/889 |
| 4,957,451 | * | 9/1990 | Nadin | 439/395 |
| 5,207,603 | | 5/1993 | Peloza . | |
| 5,222,811 | * | 6/1993 | Miyoshi | 374/208 |
| 5,681,192 | * | 10/1997 | Kobayashi et al. | 439/884 |
| 5,823,834 | * | 10/1998 | Straeb et al. | 439/884 |

FOREIGN PATENT DOCUMENTS

| | | |
|---|---|---|
| 0378466 | 1/1990 | (EP) . |
| 1 313 824 | 10/1971 | (GB) . |
| 93/13572 | 7/1993 | (WO) . |

* cited by examiner

*Primary Examiner*—Brian Sircus
*Assistant Examiner*—Brian S. Webb
(74) *Attorney, Agent, or Firm*—Kenyon & Kenyon

(57) ABSTRACT

A contact element, in particular for a welded join, having a contacting region and an attachment region for an electrical conductor, the attachment region having a reduced material thickness as compared to the contacting region and being configured integrally with the contacting region. The contacting region has two sheet-metal parts, lying against one another, of a folded sheet-metal blank; and at least one portion which is elongated and deformed in order to form the attachment region.

10 Claims, 1 Drawing Sheet

CONTACT ELEMENT

FIELD OF THE INVENTION

The present invention relates to a contact element having a contacting region and an attachment region for an electrical conductor, the attachment region having a reduced material thickness as compared to the contacting region and being configured integrally with the contacting region.

BACKGROUND INFORMATION

Contact elements configured as flat connectors are known, the contacting region being configured as a flat plug-in element for insertion into a socket, and the attachment region being configured for welding on an electrical conductor, cable, or the like. The attachment region has a lesser material thickness than the contacting region. For this purpose, the plate material is reduced to a lesser material thickness by milling or pressing. The reduction in material thickness decreases the forces that are necessary in order to bend the material when the electrical conductor or cable is secured, this reduction allows the welding current flow to be modified or optimized.

SUMMARY OF THE INVENTION

It is an object of the present invention to create homogeneous geometrical conditions for positioning and welding an electrical conductor onto the contact element, without thereby requiring a time-consuming and costly milling operation.

According to the present invention, the contacting region has at least two sheet-metal parts, lying against one another, of a folded sheet-metal blank; and at least a portion of the sheet-metal blank is elongated and deformed in order to form the attachment region.

According to the present invention, it has been recognized that a homogeneous geometrical configuration of the contact element for positioning of an electrical conductor, for example a contact wire, for the subsequent welding operation is possible even without the use of time-consuming and costly milling machines. Instead of reducing the material thickness of the sheet-metal blank in the attachment region, according to the present invention the material thickness of the sheet-metal blank is selected in accordance with the desired reduced material thickness in the attachment region. The different material thicknesses are then produced by folding over the sheet-metal blank once or several times in the contacting region. The contact element according to the present invention can be used as a plug-in or screw-in contact, and is soldered or welded to an electrical conductor in the attachment region. Press-folding of the sheet-metal blank is associated with less material loss and lower tool costs as compared with conventional methods. The contact element according to the present invention can moreover be manufactured with much less expenditure of time.

A one-piece sheet-metal blank with a desired geometry is punched or separated out from a piece of metal plate made of conductive material. Since the geometrical requirements for the sheet-metal blank are defined even before processing, material wastage during manufacture of the contact element can be minimized, for example with the use of computers.

In a first embodiment of the present invention, a cutout is formed in the sheet-metal blank between the contacting region and the attachment region. The cutout on the one hand facilitates the independent geometrical shaping, i.e. folding or press-folding of the sheet-metal blank to form the contacting region and attachment region. The cutout in the transition region can be produced in accordance with the desired application. Depending on the configuration of the cutout, an unequivocal energy expenditure can be defined for the operation of compressing or folding over the sheet-metal blank, and an exactly predetermined welding operation can thereby be performed. The cutout moreover results in a reduction in cross section in the transition region between the attachment region and the contacting region, thus achieving a lower welding current flow in the transition region. The welding procedure during attachment of the electrical conductor to the contact element can thus be additionally controllable. The electrical conductor is preferably a metal wire.

The contacting region is preferably embodied as two sheet-metal parts of the sheet-metal blank, folded or pressed-folded parallel to one another. It is thereby possible, advantageously, to create in the contacting region a plug-in tongue with two, three, or many times the material thickness of the sheet-metal blank. Press-folding or folding also makes it possible, however, to produce a plug-in tongue with different cross sections, for example a triangular cross section.

In another advantageous embodiment of the present invention, the attachment region has a folded sheet-metal part whose two limbs surround the electrical conductor in clamping fashion. The electrical conductor is thereby fastened to the contact element, and can thereafter easily be mechanically welded.

To prevent problems with the welding operation for thick electrical conductors, the complete contact element can be press-folded at one bending edge, such that in the contacting region the folded sheet-metal parts lie parallel next to one another, and in the attachment region the two limbs splay apart from one another to receive the electrical conductor. The electrical conductor can be fastened in the attachment region of the contact element by way of a pressing or stamping operation. In a particularly preferred embodiment of the present invention, the attachment region has two sheet-metal parts, joined to one another only via the contacting region, for grasping the electrical conductor, e.g. a contact wire. For this purpose, the attachment region has two separate sheet-metal parts which are each joined to the contacting region via webs formed by the cutout in the transition region. The two sheet-metal parts can lie with a small spacing opposite one another by folding the sheet-metal blank of the contact element, and can have on one side at least one lobe which is raised and forms a stop for the electrical conductor.

The sheet-metal parts of the attachment region either can be configured flat and parallel to one another, or can be embodied in bent fashion in the form of a clamp to receive the electrical conductor.

Preferably, at least one sheet-metal part of the attachment region has an impression to form a clamp receptacle. The impression creates, for example, a depression in the sheet-metal part, which enhances the clamping effect in the attachment region in this region. The impression can also serve, however, to position the welding punch at a predefined point in the attachment region. By way of a pre-impression operation, the wire cross section of the electrical conductor and the material thickness of the contact tongue in the contacting region can be matched to one another, and configured in the manner of a "projection weld."

In the attachment region, two lateral stops can facilitate axial introduction of the electrical conductor into the attachment region, and prevent lateral shifting or slippage of the electrical conductor out of the attachment region. It is also possible, however, to provide only one lateral stop in order to allow lateral introduction of the electrical conductor into the attachment region.

DETAILED DESCRIPTION

Figure 1:
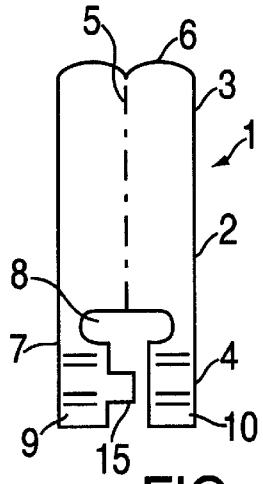
FIG. 1 shows a view of the unfolded sheet-metal blank of the contact element according to the present invention, as defined by a first embodiment.
Figure 2:
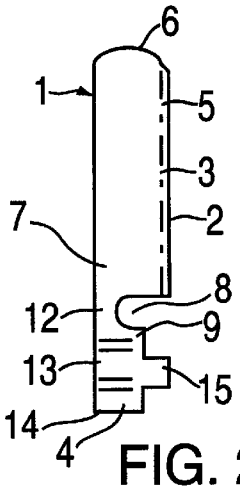
FIG. 2 shows a view of the folded sheet-metal blank of the contact element according to the present invention, as defined by the first embodiment.

Contact element 1 has a sheet-metal blank 2 with contacting region 3 and attachment region 4. In the unfolded state, sheet-metal blank 2 is substantially symmetrical about bending line 5.

Contacting region 3 forms a plug-in tongue for insertion into a mating connector, and thus in the folded state has an elongated, approximately quadrangular shape with a rounded region 6 for easier introduction into the mating connector. Contacting region 3 can taper conically toward region 6 for optimal introduction into the mating connector.

In the unfolded state, a cutout 8 is arranged in a transition region 7 arranged between contacting region 3 and attachment region 4. Cutout 8 allows independent folding of contacting region 3 and attachment region 4. Sheet-metal blank 2 is preferably folded in contacting region 3 in such a way that sheet-metal parts 9 and 10 lie parallel to one another, while in attachment region 4, sheet-metal parts 9 and 10 are at least locally splayed apart from one another after folding in order to receive the electrically conductive contact wire 11. Cutout 8 in transition region 7 moreover creates a reduction in cross section in transition region 7, resulting in a lower welding current flow during the weld joining operation between contact element 1 and contact wire 11.

Figure 3:
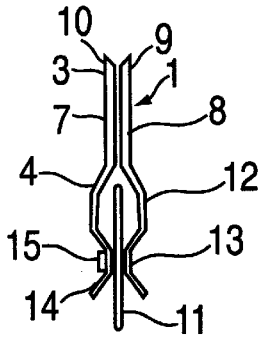
FIG. 3 shows a side view of the contact element according to the present invention with an electrical conductor in position, as defined by the first embodiment.

FIG. 3 depicts contact element 1 folded along bending line 5, showing sheet-metal parts 9 and 10, lying parallel to one another, in contacting region 3, and locally splayed-apart sheet-metal parts 9 and 10 in attachment region 4 for clamping positioning of contact wire 11. The specific configuration of sheet-metal parts 9 and 10 in attachment region 4 can be attained either by a stamping operation or by special pressing. In a segment 12, sheet-metal parts 9 and 10 are arranged at a greater spacing from one another; in a segment 13, sheet-metal parts 9 and 10 rest tightly against one another for clamping positioning of contact wire 11; and in an end segment 14, sheet-metal parts 9 and 10 splay apart from one another to receive contact wire 11.

A lateral stop 15 is configured as a tab (or lobe) in sheet-metal blank, and is canted out perpendicularly during folding. Contact wire 11 can thus be introduced from the side between the two folded sheet-metal parts 9 and 10 of contact element 1, and is kept from sliding out on one side.

Figure 7:
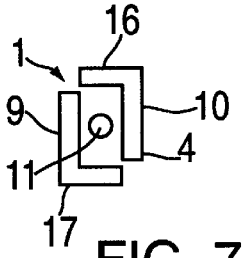
FIG. 7 shows a view of the attachment region of the contact element according to the present invention, with two lateral stops and with an electrical conductor in position.

As depicted in FIG. 7, two opposing lateral stops (or lobes) 16 and 17 can also be arranged on sheet-metal parts 9 and 10, so that contact wire 11 can be introduced, parallel to the longitudinal axis of contact element 1, into attachment region 4 and is protected from sliding out laterally.

Figure 4:
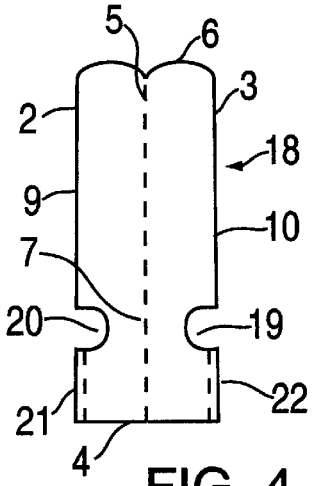
FIG. 4 shows a view of an unfolded sheet-metal blank of the contact element according to the present invention, as defined by a second embodiment.
Figure 5:
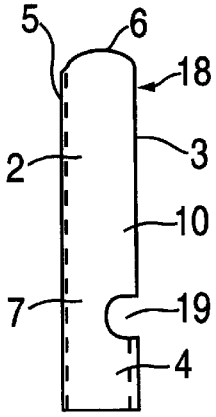
FIG. 5 shows a view of the folded sheet-metal blank of the contact element according to the present invention, as defined by the second embodiment.
Figure 6:
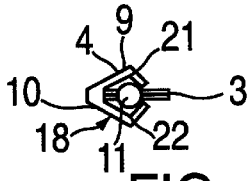
FIG. 6 shows a view of the folded attachment region of the contact element according to the present invention with an electrical conductor in position, as defined by the second embodiment.

FIGS. 4, 5, and 6 depict a second embodiment of contact element 18 according to the present invention. Contact element 18 has a sheet-metal blank 2 which has two sheet-metal parts 9 and 10 that are completely continuous along bending line 5. Cutouts 19 and 20 in transition region 7 are arranged symmetrically with respect to bending line 5, and on the external peripheral edge of sheet-metal blank 2. Two end sections 21 and 22 that can be canted out allow contact wire 11 to be positioned in attachment region 4, as depicted in FIG. 6. The present embodiment is particularly suitable for large-diameter contact wires 11.

Figure 8:
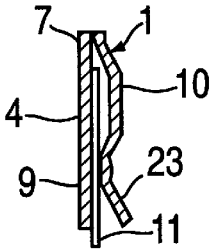
FIG. 8 shows a side view of the attachment region of the contact element according to the present invention, with a stamped sheet-metal part and an electrical conductor in position.

FIG. 8 depicts a further embodiment of attachment region 4. In FIG. 8, only one sheet-metal part 10 is stamped for clamping reception of contact wire 11, while sheet-metal part 9 is configured as a flat tab. For better positioning, a groove arranged parallel to the longitudinal axis of contact wire 11 could also be stamped into this tab.

Figure 9:
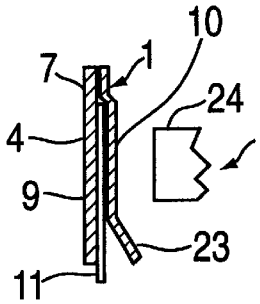
FIG. 9 shows a side view of the attachment region of the contact element according to the present invention during the welding operation.

FIG. 9 depicts a further embodiment of attachment region 4 with two substantially flat sheet-metal parts 9 and 10, end region 23 being bent up for easier reception of contact wire 11, and sheet-metal parts 9 and 10 being arranged parallel to one another with a spacing corresponding to contact wire 11. Also depicted, for illustration, is welding punch 24, which during the welding operation can be brought in the direction of the arrow against attachment region 4 of contact element 1, and creates the join between contact element 1 and contact wire 11.

What is claimed is:

1. A contact element comprising:

an attachment region for contacting the contact element to an electrical conductor;

a transition region; and a contacting region, the transition region being disposed between the attachment region and the contacting region, the attachment region having a smaller material thickness than the contacting region, the attachment region being configured integrally with the contacting region, the contacting region including at least two sheet-metal parts, lying against one another, of a folded sheet-metal blank, the attachment region including another at least two sheet-metal parts of the folded sheet-metal blank integrally joined via the transition region to the at least two sheet-metal parts, at least a portion of the sheet-metal blank being elongated and deformed to form the attachment region, wherein the transition region includes a cutout that results in a reduced cross-sectional area in the transition region relative to cross-sectional areas of the attachment region and the contacting region, and wherein the cutout partially encloses an open area that is in communication with a space that keeps each one of the other at least two sheet-metal parts apart from each other, thereby allowing independent folding operations to be performed on the attachment region and the contacting region.

2. The contact element according to claim 1, wherein the at least two sheet-metal parts are at least one of folded and press-folded parallel to one another.

3. The contact element according to claim 1, wherein a portion of the at least two sheet-metal parts is in the attachment region and includes two limbs surrounding the electrical conductor in a clamping fashion, the electrical conductor being a wire.

4. The contact element according to claim 1, wherein at least one of the at least two sheet-metal parts has a raised lobe to form a stop.

5. The contact element according to claim 1, wherein the at least two sheet-metal parts are folded in a substantially parallel fashion and are arranged spaced apart to receive the electrical conductor.

6. The contact element according to claim 1, wherein at least one of the at least two sheet-metal parts has an impression form a clamp receptacle.

7. The contact element according to claim 4, wherein the raised lobe is disposed in the attachment region.

8. The contact element according to claim 1, wherein the attachment region includes a plurality of limbs depending from the transition region, and wherein at least one of the plurality of limbs includes an impression formed as a clamp receptacle.

9. The contact element according to claim 1, wherein:

the independent folding operations include a folding of the at least two sheet metal parts in the contacting region to lie parallel to each other and a folding of the other at least two sheet-metal parts to be locally splayed apart from each other.

10. A contact element comprising:

an attachment region for contacting the contact element to an electrical conductor;

a transition region; and a contacting region, the transition region being disposed between the attachment region and the contacting region, the attachment region having a smaller material thickness than the contacting region, the attachment region being configured integrally with the contacting region, the contacting region including at least two sheet-metal parts, lying against one another, of a folded sheet-metal blank, at least a portion of the sheet-metal blank being elongated and deformed to form the attachment region, wherein a plurality of portions of the at least two sheet-metal parts are in the attachment region and are joined to one another only via the contacting region, for grasping the electrical conductor, wherein the transition region includes a cutout that results in a reduced cross-sectional area in the transition region relative to cross-sectional areas of the attachment region and the contacting region, and wherein the cutout partially encloses an open area that is in communication with a space that keeps each one of the plurality of portions of the at least two sheet-metal parts in the attachment region apart from each other, thereby allowing independent folding operations to be performed on the attachment region and the contacting region.

* * * * *